US007318716B2

(12) United States Patent
Castagnetta, Jr.

(10) Patent No.: US 7,318,716 B2
(45) Date of Patent: Jan. 15, 2008

(54) MASTIC APPLICATOR WITH ADJUSTABLE TROWELLING BAR

(75) Inventor: David Joseph Castagnetta, Jr., Lawrenceville, GA (US)

(73) Assignee: Axia, Inc., Duluth, GA (US)

( * ) Notice: Subject to any disclaimer, the term of this patent is extended or adjusted under 35 U.S.C. 154(b) by 254 days.

(21) Appl. No.: 11/048,967

(22) Filed: Feb. 2, 2005

(65) Prior Publication Data

US 2006/0171761 A1 Aug. 3, 2006

(51) Int. Cl.
*B29C 59/02* (2006.01)

(52) U.S. Cl. ..... 425/87; 425/458; 15/235.3; 15/235.4; 401/203; 401/266

(58) Field of Classification Search ..... 425/87, 425/458; 15/235.3, 235.4, 235.7, 235.8; 401/9, 203, 266
See application file for complete search history.

(56) References Cited

U.S. PATENT DOCUMENTS

| | | | | |
|---|---|---|---|---|
| 2,984,857 | A | 5/1961 | Ames | |
| 4,129,407 | A | 12/1978 | Golls | |
| 4,516,868 | A | 5/1985 | Molnar | |
| 5,122,006 | A | 6/1992 | MacMillan | |
| 5,143,264 | A | 9/1992 | MacMillan | |
| 5,792,489 | A * | 8/1998 | Liberman | 425/458 |
| 6,146,039 | A | 11/2000 | Pool et al. | |

* cited by examiner

*Primary Examiner*—Yogendra N. Gupta
*Assistant Examiner*—Thu Khanh T. Nguyen
(74) *Attorney, Agent, or Firm*—Michael Best & Friedrich LLP

(57) ABSTRACT

A tool for applying mastic to drywall, having a flexible trowelling bar for smoothing and shaping the applied mastic. The curvature of the trowelling bar is controlled by the rotation of a cam that is positioned on a rigid support and that is directly coupled to the trowelling bar through a link. Springs are positioned between the rigid support and the trowelling bar to maintain tension on the link during rotation of the cam. The springs exert pressure on the trowelling bar through plungers having rounded feet that maintain consistent contact with the trowelling bar as the curvature of the trowelling bar changes.

23 Claims, 4 Drawing Sheets

MASTIC APPLICATOR WITH ADJUSTABLE TROWELLING BAR

BACKGROUND OF THE INVENTION

The present invention relates to tools for applying mastic and especially to flat finisher tools for applying mastic to drywall joints.

Flat finisher tools are well known in the housing construction and drywall industries, and are used to apply a coating of mastic to conceal the joints between drywall panels. An example of a typical flat finisher tool is provided by U.S. Pat. No. 2,984,857, which is incorporated herein by reference. Conventional flat finisher tools consist of a container for holding a supply of mastic, with an opening for dispensing the mastic. A flexible trowelling bar is attached to the tool for shaping and smoothing the surface of the applied mastic. As the mastic is dispensed, the trowelling bar flexes over the applied mastic to form a concave curve that shapes the mastic into a layer that is thick in the center and is feathered or thin at the edges to blend into the surface of the drywall.

The curvature of the trowelling bar and, therefore, the thickness of the applied mastic, is indirectly controlled by a cam that regulates the pressure exerted by a leaf spring on the trowelling bar. Actuating the cam increases the pressure on the leaf spring, which increases the pressure on the trowelling bar to reduce its curvature and produce a thinner layer of mastic. However, the leaf spring often becomes distorted after repeated use, which reduces its effectiveness in controlling the curvature of the trowelling bar.

The trowelling bar typically comprises a normally flat blade mounted in a brass rod that serves as a blade guide. Because the curvature of the trowelling bar depends on its ability to flex over the mastic, numerous slots are cut perpendicular to the longitudinal axis of the brass rod to increase its flexibility and ensure that the blade guide will arch or curve properly as it passes over the mastic. Forming these slots requires extensive machining and adds to the expense of manufacturing the trowelling bar. In addition, the brass trowelling bar is relatively heavy, making the tool more difficult to wield and more tiring to use.

Thus, there is a need for a flat finisher tool that reduces or eliminates the reliance on a leaf spring to control the curvature of the trowelling bar. In addition, there is a need for a trowelling bar that is simpler and less expensive to manufacture, and that is made of lighter weight materials.

SUMMARY OF THE INVENTION

In accordance with the present invention, a flat finisher tool is described that comprises a container with an opening for dispensing mastic. A flexible trowelling bar is mounted on the container for shaping the dispensed mastic. A rotating cam is positioned on a rigid support connected to the container, and is directly coupled to the trowelling bar, such that the rotation of the cam controls the curvature of the trowelling bar. At least one spring is positioned between the trowelling bar and the support to bias the trowelling bar away from the cam.

DETAILED DESCRIPTION OF THE INVENTION

Figure 1:
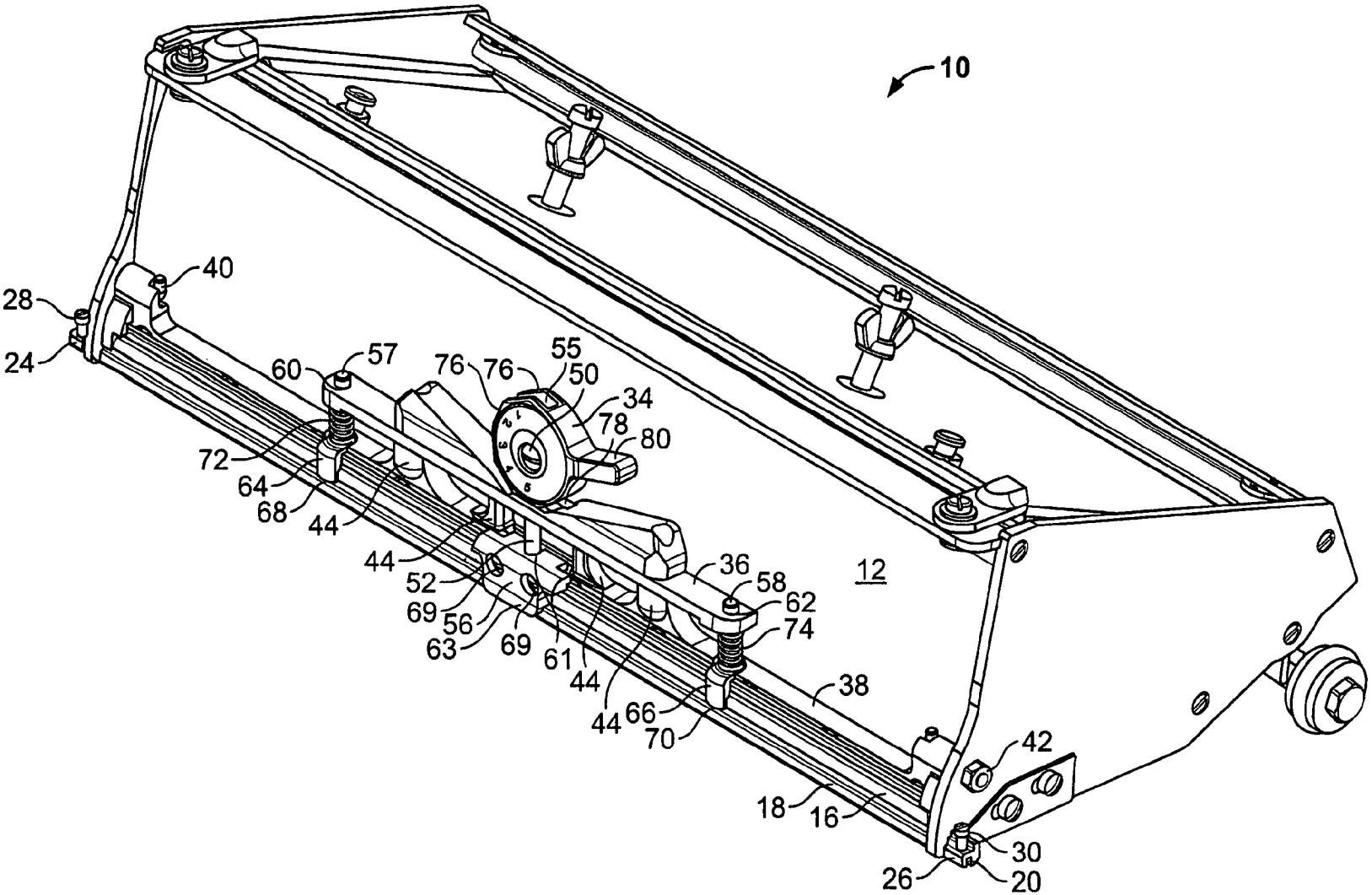
FIG. 1 shows a perspective view of a flat finisher tool in accordance with the present invention.

Referring to FIGS. 1-4, flat finisher 10 comprises a container 12 for holding a supply of mastic (also referred to as joint compound or mud). The operator slides flat finisher 10 over a drywall joint as mastic is dispensed through an opening 14. The mastic then is shaped and smoothed over the drywall joint by a trowelling bar 16.

Trowelling bar 16 comprises a blade guide 18 with a slot 20 that holds a blade 22. The ends 24, 26 of blade guide 18 are received in slots 25, 27 formed in the sides of container 12, and are held in position by flanges 29, 31. Screws 28, 30 are provided at ends 24, 26 of blade guide 18 for adjusting the depth of blade 22 in slot 20. In a preferred embodiment, blade guide 18 is made of aluminum and blade 22 is made of stainless steel. In an alternative embodiment, trowelling bar 16 may have an aluminum blade guide with a composite, plastic blade or trowelling bar 16 may be formed as an integrated plastic guide/blade.

Figure 2:
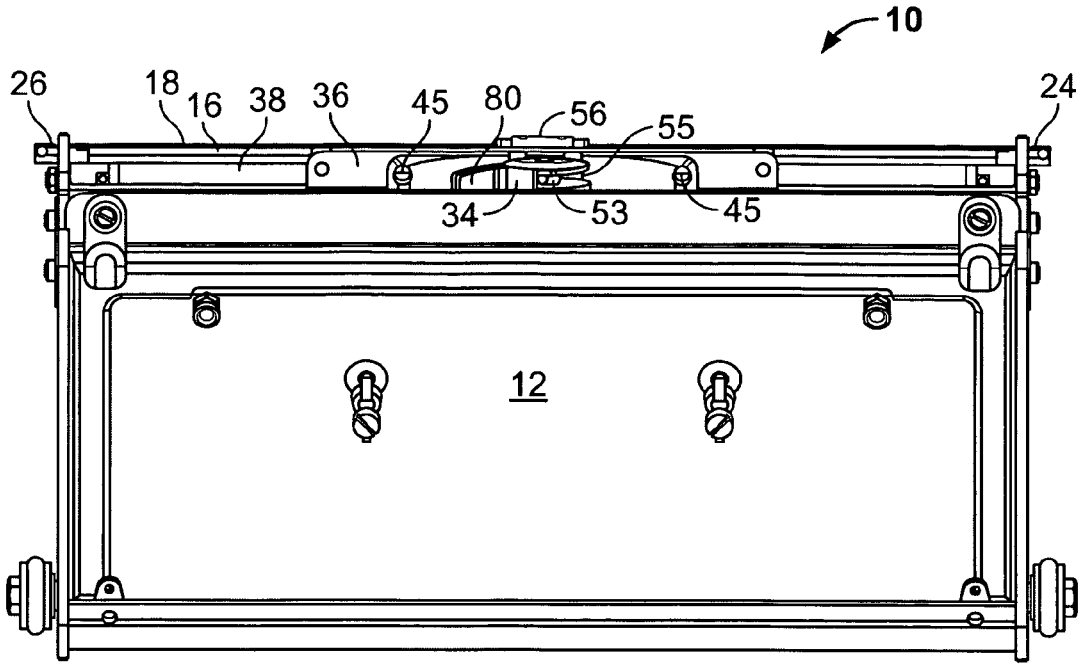
FIG. 2 shows a top plan view of the flat finisher tool of FIG. 1.
Figure 3:
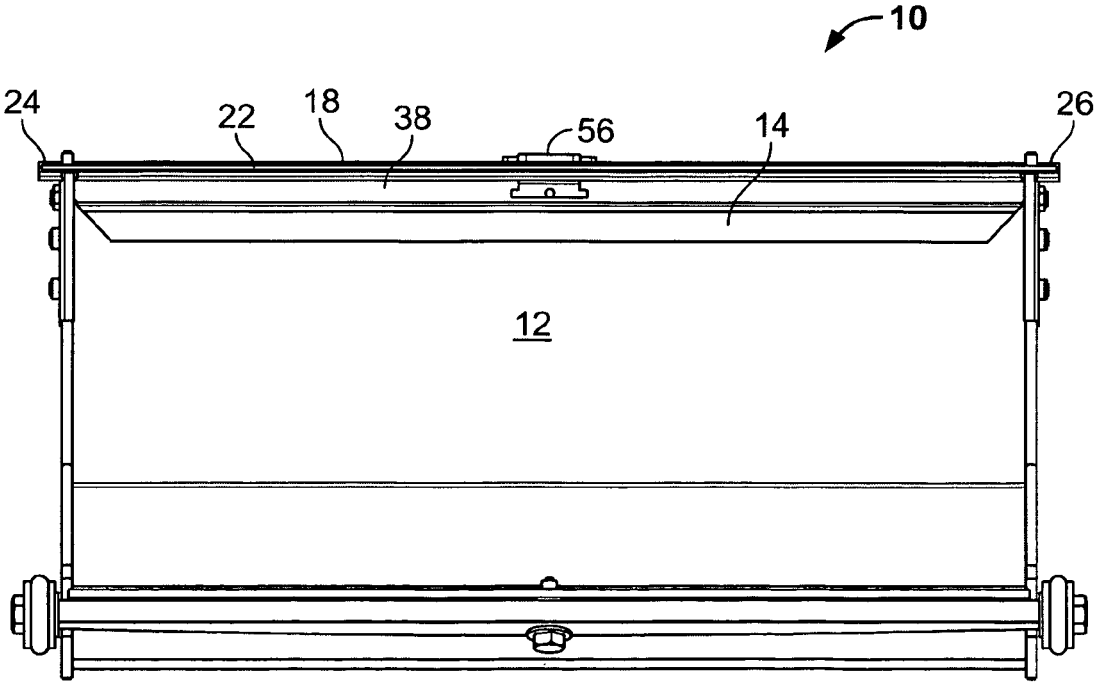
FIG. 3 shows a bottom plan view of the flat finisher tool of FIG. 1.

The middle portion 32 of blade guide 18 is not connected to container 12 and is free to flex relative to ends 24, 26, thereby allowing the trowelling bar to form a concave or convex curve relative to the drywall surface (not shown). The amount of curvature of trowelling bar 16 is controlled by a substantially circular cam 34, that rests on a rigid support 36. Rigid support 36 is held in place by a brace 38 that substantially spans and is attached to container 12 by bolts 40, 42 and screws 43. As best shown in FIGS. 1 and 2, rigid support 36 rests on and is secured by screws 45 to columns 44 formed in brace 38.

Figure 4:
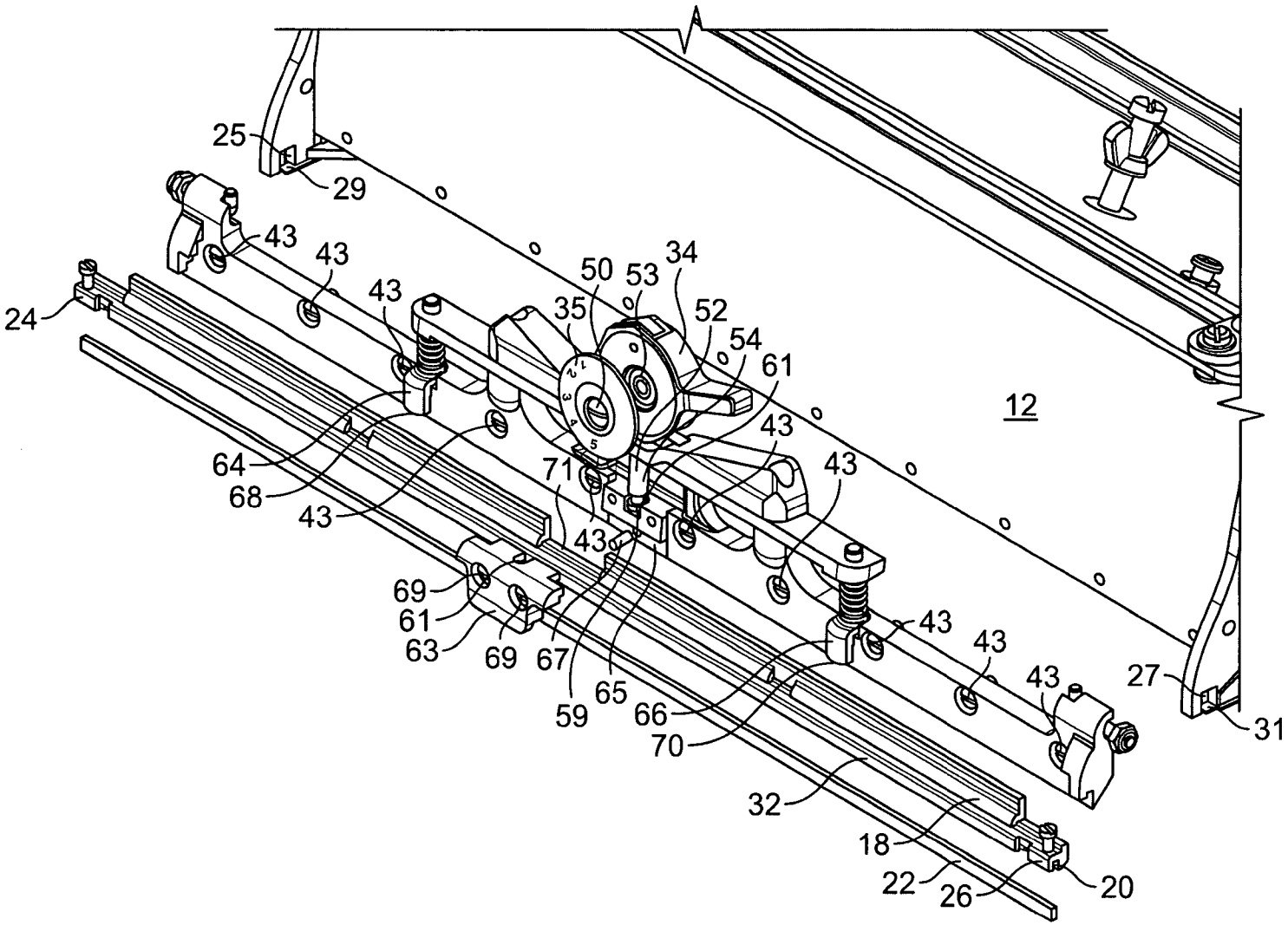
FIG. 4 shows an exploded perspective view of a portion of the flat finisher tool of FIG. 1.
Figure 5:
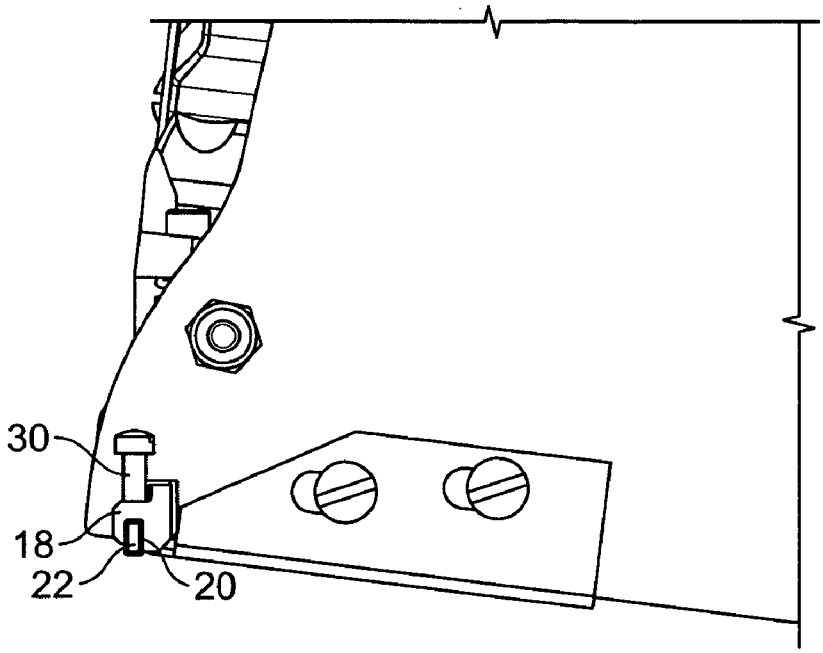
FIG. 5 shows a detail side elevation view of the trowelling bar in the flat finisher tool of FIG. 1.
Figure 6:
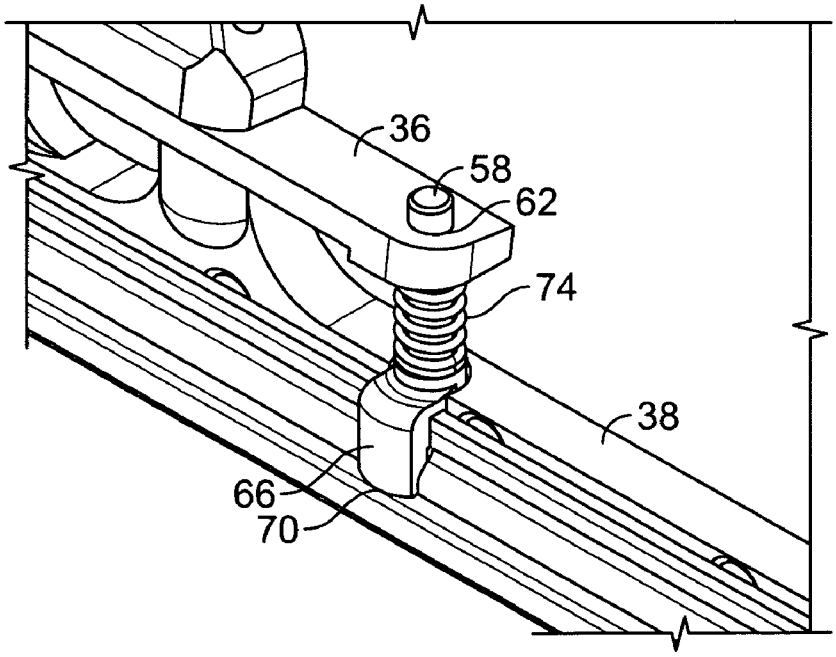
FIG. 6 shows a detail perspective view of the plunger in the flat finisher tool of FIG. 1.

Cam 34 rotates on an eccentrically placed pivot 50 that is offset from the center of the cam and is coupled to trowelling bar 16 through a link 52. As best shown in FIG. 4, end 53 of link 52 is connected to pivot 50 and is positioned within a slot 55 formed in cam 34. Opposite end 54 of link 52 is connected to trowelling bar 16 by a clip 56. Clip 56 is formed of halves 63, 65 that are secured together by screws 69. End 54 of link 52 is provided with a stud 59 that is retained within a slot 61 formed between halves 63, 65 of clip 56. Middle portion 32 of blade guide 18 is sandwiched between halves 63, 65 and is connected to clip 56 by a pin 67. A notch 71 is provided in middle portion 32 of blade guide 18 that is sized and shaped to receive clip 56.

A pair of posts or plungers 57, 58 slide within openings 60, 62 formed in support 36, and extend between support 36 and blade guide 18. Plungers 57, 58 are provided with feet 64, 66 having rounded bottom surfaces 68, 70 that contact blade guide 18. Coil springs 72, 74 are mounted externally around plungers 56, 58 and maintain tension on link 52 as cam 34 is rotated by exerting pressure on blade guide 18 through feet 64, 66 to bias trowelling bar 16 away from support 36 and cam 34. Rounded bottom surfaces 68, 70 ensure that feet 64, 66 maintain consistent contact with blade guide 18 as the curvature of trowelling bar 16 is changed.

The curvature of the trowelling bar in the inventive flat finisher tool is not dependent on its flexibility. Cam 34 is directly coupled to trowelling bar 16, such that the action of the cam positively controls curvature of the trowelling bar. The rotation of cam 34 in the counterclockwise direction causes offset pivot 50 to move away from rigid support 36, which, in turn, causes link 52 to move upward, toward the cam. The upward movement of link 52 pulls middle portion 32 of trowelling bar 16 toward cam 34 and causes the trowelling bar to form a concave curve relative to the drywall surface. The further cam 34 is rotated in the counterclockwise direction, the greater the curvature of trowelling bar 16.

Conversely, the rotation of cam 34 in the clockwise direction causes offset pivot 50 to move toward rigid support 36, which, in turn, causes link 52 to move downward, away from the cam. The downward movement of link 52 pushes middle portion 32 of trowelling bar 16 outward and away from cam 34 to reduce or flatten the curvature of the trowelling bar. The further cam 34 is rotated in the clockwise direction, the flatter the curve of trowelling bar 16. Depending on the length of link 52, it is possible that the clockwise rotation of cam 34 may cause link 52 to push trowelling bar 16 outward enough to form a convex curve relative to the drywall surface. Springs 72, 74 operate with plungers 56, 58 and rigid support 36 to maintain tension on link 52 and ensure that cam 34 remains seated on support 36 during the operation of the cam.

Because the curvature of trowelling bar is positively controlled by the operation of the cam, the trowelling bar does not need to be machined to increase its flexibility as in conventional flat finishing tools. This permits the trowelling bar to be manufactured much more simply and less expensively, and from a wider range of materials than in conventional tools where the trowelling bar must be sufficiently resilient to flex over the mastic and form a curve. Thus, trowelling bar 16 need not be formed with a series of perpendicular slots, and may be formed of lighter materials such as aluminum and plastic rather than brass, as described above.

In a preferred embodiment, cam 34 is provided with a plurality of peripherally located flat facets 76 that function as detents during the rotation of the cam, by providing resistance to rotation as each flat facet comes into contact with the flat surface 78 of support 36. Each facet 76 serves as a different setting for adjusting the amount of curvature of trowelling bar 16 and the thickness of the applied mastic. As shown in FIGS. 1 and 4, cam 34 is provided with a dial 35 marked with indicia "1" through "5" identifying the position of each facet 76. As best shown in FIG. 1, when cam 34 is rotated to position "5," offset pivot 50 is closest to rigid support 36 and link 52 pushes trowelling bar 16 outward to form a flat curve that is parallel to the drywall surface. As cam 34 is sequentially rotated from position "5" to position "1," offset pivot moves further away from rigid support 36 and link 52 pulls trowelling bar 16 upward to form an increasingly concave curve relative to the drywall surface. Thus, position "5" corresponds to a setting where trowelling bar 16 has no curvature and, consequently, applies the least amount of mastic to the drywall surface. Position "1" corresponds to the setting where trowelling bar 16 has the greatest curvature and applies the thickest layer of mastic. A handle 80 is formed in cam 34 to facilitate manual rotation of the cam between each setting.

It will be apparent to those of skill in the art that modifications may be made without departing from the spirit and scope of the invention. Accordingly, it is not intended that the invention be limited except in view of the appended claims.

What is claimed is:

1. A tool for applying mastic, comprising:
- a container for dispensing mastic;
- a flexible trowelling bar mounted on said container for shaping the dispensed mastic;
- a rigid support connected to said container;
- a cam positioned on said rigid support and coupled to said trowelling bar;
- at least one spring positioned between said trowelling bar and said rigid support to bias said trowelling bar away from said rigid support;
- wherein the operation of said cam controls the curvature of said trowelling bar; and
- at least one post slidably mounted to said rigid support, said post having a foot that contacts said trowelling bar.

2. The tool of claim 1, further comprising a link having first and second ends, said first end connected to said cam and said second end connected to said trowelling bar.

3. The tool of claim 1, wherein said cam is substantially circular with a pivot offset from its rotational center, said cam having a plurality of peripherally located facets; and wherein the operation of said cam causes an alternate one of said facets to contact said rigid support.

4. The tool of claim 1, wherein said rigid support includes a surface and said cam includes an outer surface positioned on said surface of said rigid support.

5. The tool of claim 1, wherein said foot has a rounded surface that contacts said trowelling bar.

6. The tool of claim 1, wherein said spring is a coil spring wrapped about said post.

7. The tool of claim 1, wherein said trowelling bar comprises a blade and a blade guide having a slot for receiving said blade.

8. The tool of claim 7, wherein said blade is made of steel.

9. The tool of claim 7, wherein said blade guide is made of aluminum.

10. The tool of claim 7, wherein said blade is made of plastic.

11. The tool of claim 7 wherein said blade and said blade guide are integrally formed.

12. The tool of claim 1, further comprising a brace connected to said container and including a column, and wherein said rigid support rests on the column.

13. A drywall tool for applying mastic, comprising:
- a flexible trowelling bar for shaping said mastic;
- a rigid support;
- a cam positioned on said rigid support and coupled to said trowelling bar;
- at least one spring for spring biasing said trowelling bar away from said cam, wherein the operation of the cam controls the curvature of said trowelling bar;
- wherein said spring is positioned between said trowelling bar and said rigid support; and
- at least one post slidably mounted to said rigid support, said post having a foot that contacts said trowelling bar.

14. The tool of claim 13, wherein said foot has a rounded surface that contacts said trowelling bar.

15. The tool of claim 13, further comprising a link connecting said cam to said trowelling bar.

16. The tool of claim 13, wherein said trowelling bar comprises a blade and a blade guide having a slot for receiving said blade.

17. The tool of claim 16, wherein said blade is made of steel.

18. The tool of claim 16, wherein said blade guide is made of aluminum.

19. The tool of claim 16, wherein said blade is made of plastic.

20. The tool of claim 16 wherein said blade and said blade guide are integrally formed.

21. The tool of claim 13, wherein said cam is substantially circular with a pivot offset from its rotational center, said cam having a plurality of peripherally located facets, any one of which can be rotated to contact said rigid support.

22. The tool of claim 13, wherein the rigid support includes a surface and the cam includes an outer surface positioned on the surface of the rigid support.

23. The tool of claim 13, further comprising a brace connected to said container and including a column, and wherein said rigid support rests on the column.

* * * * *